US006990895B2

(12) United States Patent
Powers

(10) Patent No.: US 6,990,895 B2
(45) Date of Patent: Jan. 31, 2006

(54) SIDE SEAL STRAPPING MACHINE

(75) Inventor: Thomas A. Powers, Arlington Heights, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 7 days.

(21) Appl. No.: 10/785,514

(22) Filed: Feb. 24, 2004

(65) Prior Publication Data

US 2005/0061165 A1 Mar. 24, 2005

Related U.S. Application Data

(60) Provisional application No. 60/501,677, filed on Sep. 10, 2003.

(51) Int. Cl.
*B65B 13/04* (2006.01)

(52) U.S. Cl. ..... 100/27; 100/29; 53/589

(58) Field of Classification Search ..... 100/25, 100/26, 29, 32, 33 R, 33 PB; 53/589
See application file for complete search history.

(56) References Cited

U.S. PATENT DOCUMENTS 2,194,108 A * 3/1940 Parvin Wright ..... 100/26
3,118,584 A * 1/1964 Brouse et al. ..... 226/143
3,768,396 A * 10/1973 Coleman ..... 100/26
4,254,703 A * 3/1981 Fulton et al. ..... 100/2
6,584,892 B2 7/2003 Flaum et al.
6,651,550 B2 * 11/2003 Flaum et al. ..... 100/8

* cited by examiner

*Primary Examiner*—Derris H. Banks
*Assistant Examiner*—Jimmy Nguyen
(74) *Attorney, Agent, or Firm*—Mark W. Croll, Esq.; Donald J. Breh, Esq.; Welsh & Katz, Ltd.

(57) ABSTRACT

An improved side seal strapping machine is configured to feed a strapping material around a load, position, tension and seal the strapping material around the load. The machine is configured for strapping relatively incompressible, debris laden loads. The machine includes a frame having a biased, movable carriage mounted to a side thereof, a modular sealing head mounted to the carriage and a modular feed head mounted to the carriage. A strap chute is mounted to the frame. The chute has a movable bottom chute section and a movable lower head-side section adjacent the sealing head. The movable lower head-side chute section is movable with the carriage, and the movable lower head-side chute section and the bottom section are hingedly connected to one another for cooperative movement. A passive debris ejection system includes openings formed in the bottom chute section and openings formed at junctures of the bottom chute section and sections adjacent thereto.

14 Claims, 13 Drawing Sheets

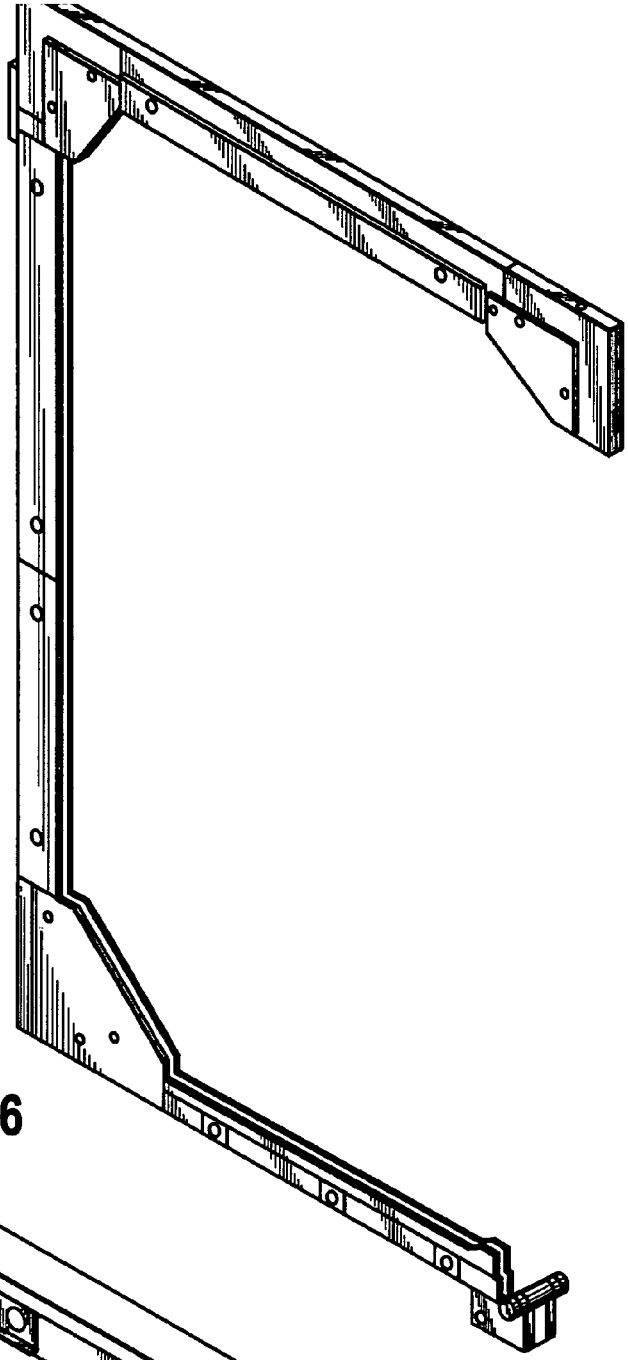
Fig. 15
Fig. 16
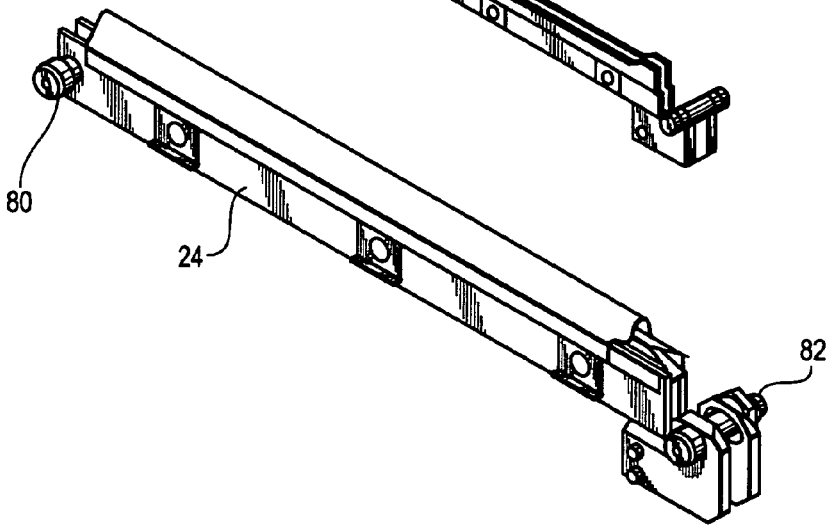

SIDE SEAL STRAPPING MACHINE

CROSS REFERENCE TO RELATED APPLICATION DATA

The application claims the benefit of priority of Provisional U.S. Patent Application Ser. No. 60/501,677, filed Sep. 10, 2003.

BACKGROUND OF THE INVENTION

The present invention is directed to an improved strapping machine. More particularly, the present invention is directed to a side seal strapping machine that is used to strap relatively incompressible, debris laden materials, such as bricks.

Strapping machines are in widespread use for securing straps around loads. The bundling of bricks by strapping is one use for such strapping machines, and has become one of the more popular methods for bundling bricks. Due to the incompressibility of the load and the debris that is generated during the strapping operation, top seal machines are in widespread use for strapping bricks. A top seal machine is configured having the strapping head positioned at the top of the strap chute, above the load. This configuration results in tensioning tightest on the top bricks of the bundle.

Although such top seal machines function quite well, there are drawbacks to these machine configurations. For example, many top sealers require a frame structure to raise and lower the strapping head so that the load can be moved into and out of the strapper (within the chute area). Such a structure can be quite large and cumbersome, adding cost, size and complexity to the overall machine.

In addition, the nature of such a machine requires a chute that is moved or positioned so that the head can be moved up and down to move the load into and out of the chute area. This too adds to the complexity of the machine and increases the opportunity for a strap misfeed due to a misaligned chute.

Although side seal strapping machines, generally, are known, use of these machines has not been made in the field of brick strapping due to the amount of debris that is generated that can adversely effect the strapping head and can block the strap chute.

Accordingly there is a need for an improved side seal strapping machine that can be used for strapping relatively incompressible, debris laden materials, such as bricks. Desirably, such a machine includes passive debris ejection provisions for clearing the strap chute of debris. More desirably, such a machine can be used without increased structure for vertically moving the strapping head toward and away from the load when positioning the load in the strapper. Most desirably, such a machine uses modular assemblies and permits "flexing" of the strap chute, while maintaining strap path alignment.

BRIEF SUMMARY OF THE INVENTION

An improved side seal strapping machine is configured to feed a strapping material around a load, position, tension and seal the strapping material around the load. The strapping machine can be used for strapping relatively incompressible, debris laden materials, such as bricks.

The machine includes a frame having a movable carriage mounted to a side thereof. The carriage moves along a vertical shaft, and is mounted to the shaft by linear bearings.

The carriage is returned to an operating position by a spring disposed about the shaft below the bearings.

A modular sealing head is mounted to the carriage and a modular feed head is mounted to the carriage. A strap chute is rigidly mounted to the frame and has a movable bottom chute section and a movable lower head-side movable section adjacent the sealing head. The movable lower head-side chute section is movable with the carriage and is hingedly connected to the bottom section for cooperative movement. In a preferred embodiment, the strapping machine is configured in a tandem arrangement having a pair of side-by-side strapping heads (sealing head and feed heads) and strap chutes.

A passive debris ejection system includes openings formed in the bottom chute section and openings formed at junctures of the bottom chute section and sections adjacent thereto. When strap material is fed into the strapping machine through the feed head and the sealing head, the strap is conveyed into the strap chute, and is tensioned around the load.

During tensioning, the carriage, carrying the sealing head and the feed head floats and is moved downward in response to tensioning. The movable strap chute sections provide a self aligning strap path upon downward float and upward return. Debris that is generated during handling of the load is ejected from the strap chute through the openings formed in the bottom chute section and the openings formed at the junctures of the bottom chute section and sections adjacent thereto.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 15 is a perspective view of the strap chute;

FIG. 16 is a perspective view of the bottom chute portion illustrating the floating and fixed pivots;

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 1:
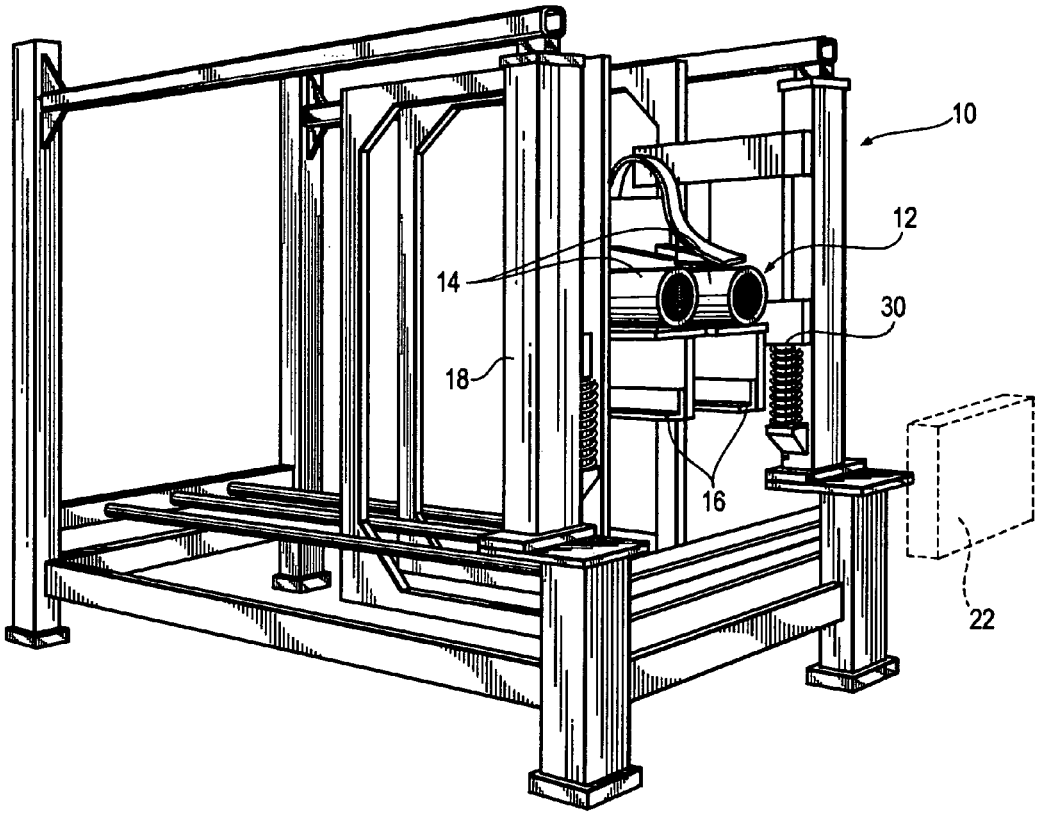
FIG. 1 is a perspective view of an assembly that includes an exemplary side seal strapping machine having a self-aligning, passive debris ejection strap chute, which strapper includes modular components.
Figure 2:
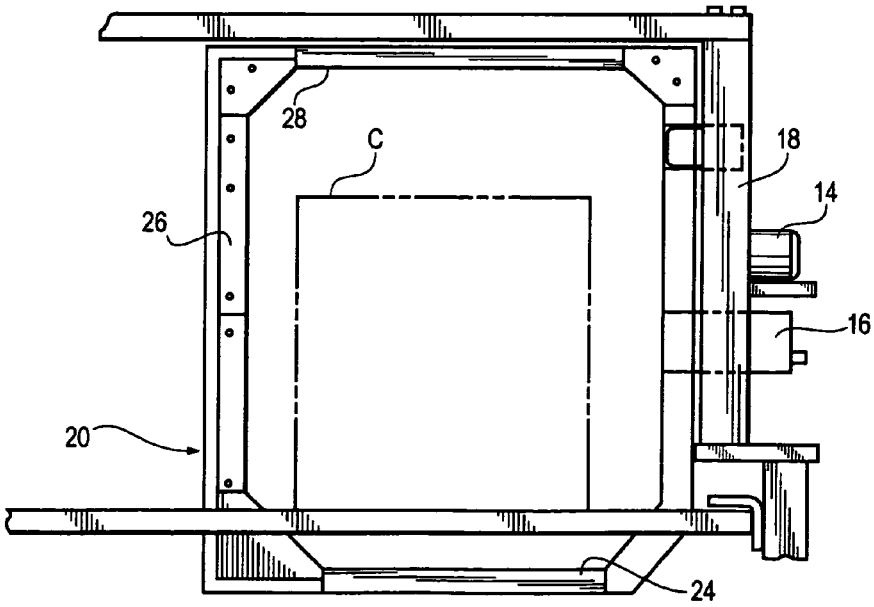
FIG. 2 is a side view of the side seal strapping machine.
Figure 3:
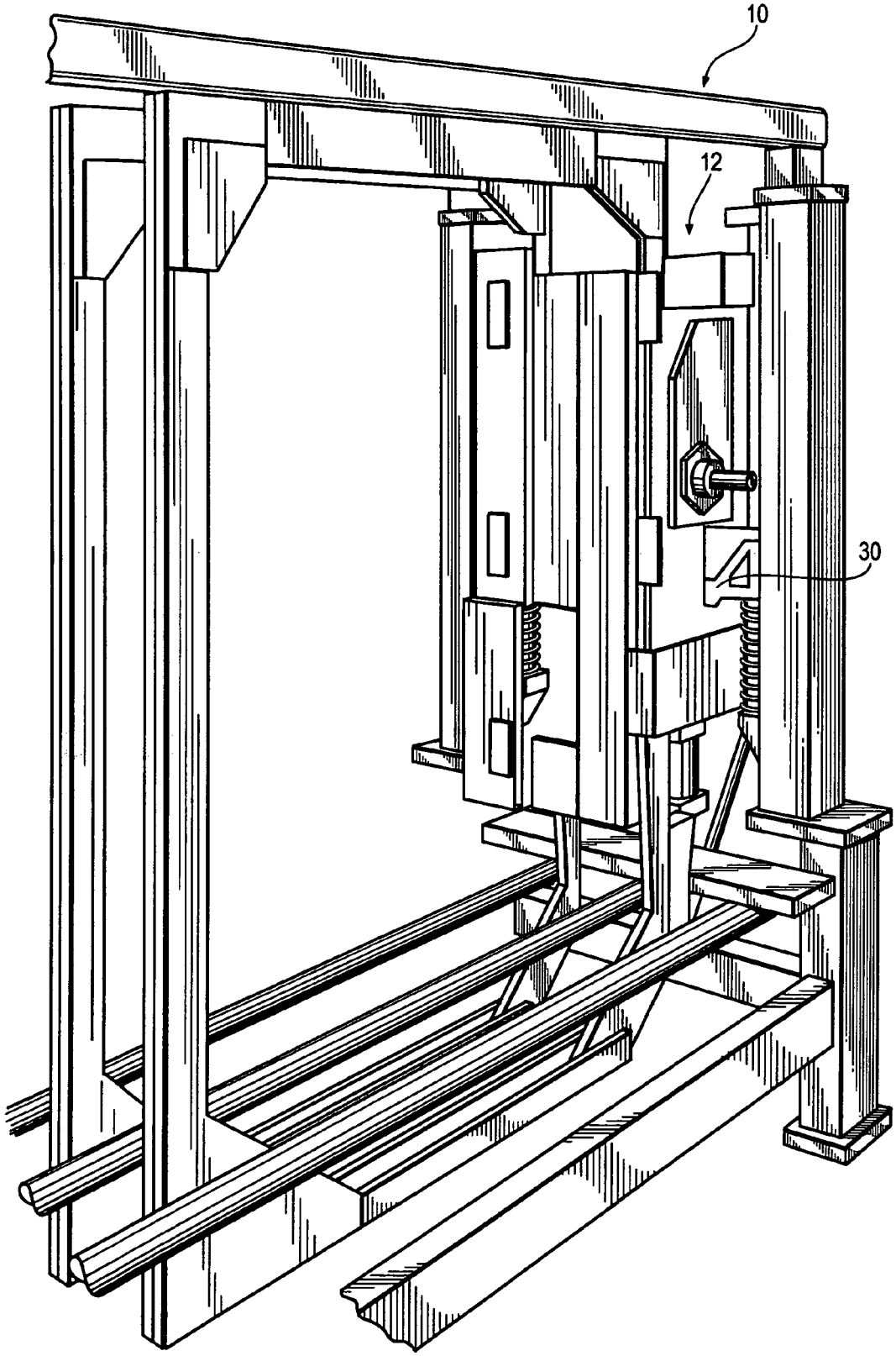
FIG. 3 is a perspective view of the side seal strapper looking in toward the strapping head.
Figure 4:
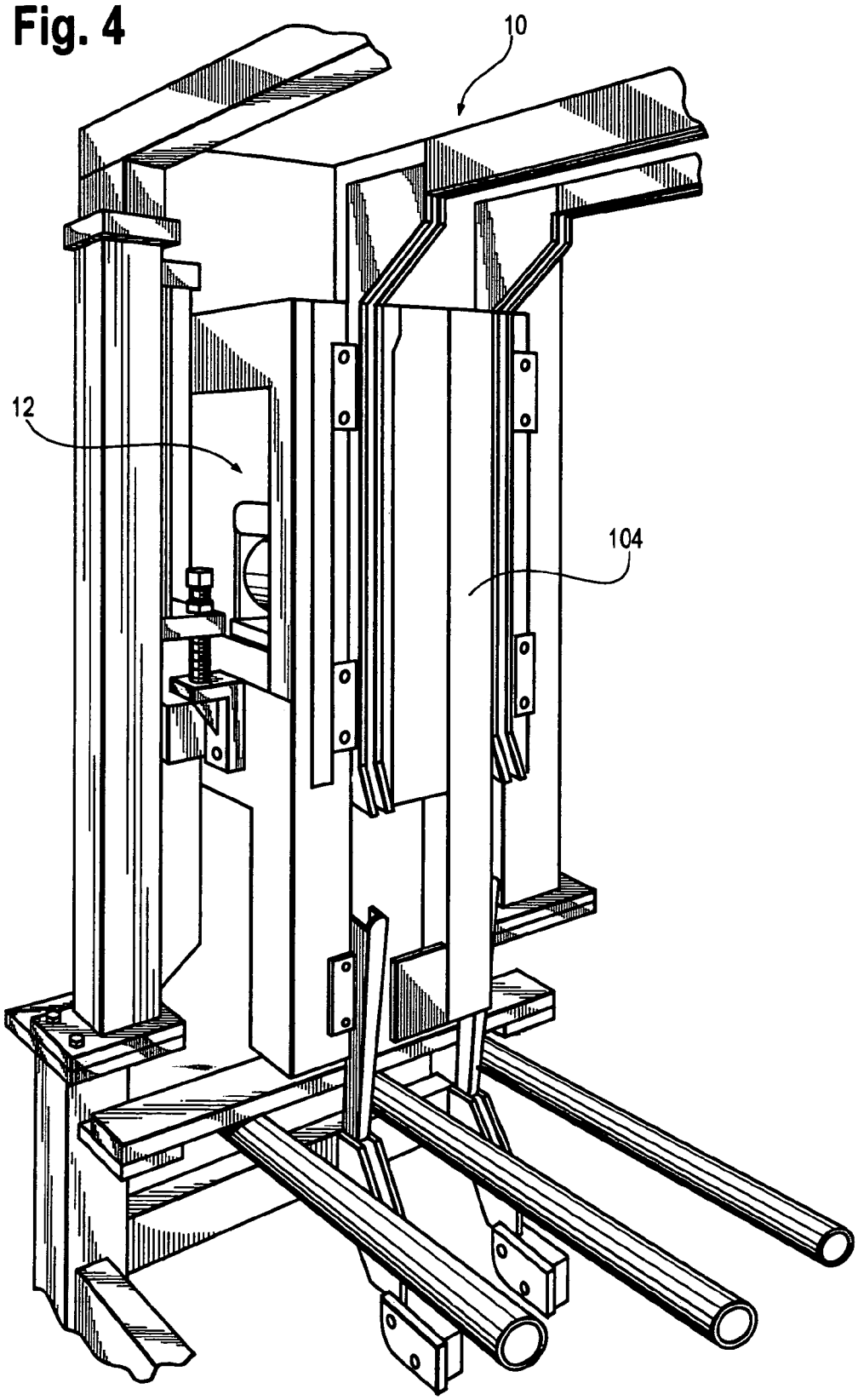
FIG. 4 is a partial perspective view similar to FIG. 3, but as seen from the opposite side from FIG. 3.
Figure 5:
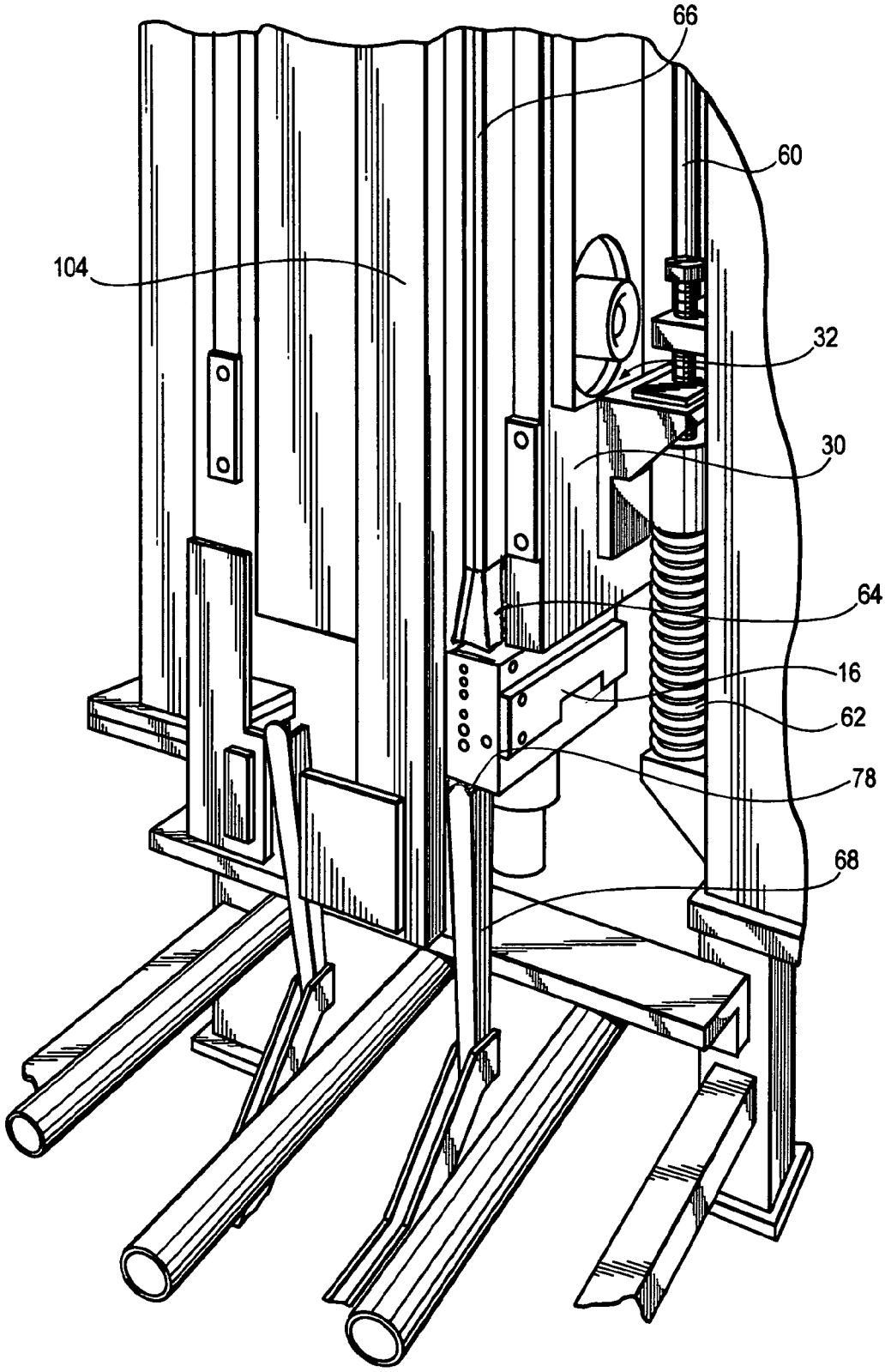
FIG. 5 is a perspective view of the bottom of the side portion of the chute showing the strapping head, the lower head-side/bottom chute juncture and the floating mount for the strapping head.

Referring to the figures and in particular to FIGS. 1–2, there is shown a side seal strapping machine 10 embodying the principles of the present invention. The illustrated strapping machine 10 is configured with side-by-side or tandem modular strapping heads 12. That is, the strapping machine 10 includes side-by-side strapping heads 12, where strapping head 12 refers, generally, to a feed head 14 and a sealing head 16, collectively. The modular components are as described in Flaum et al., U.S. Pat. No. 6,584,892, which patent is commonly assigned with the present application and is incorporated herein by reference.

The strapping machine 10 includes generally, a frame 18, a pair of strap chutes 20, the pair of strapping heads 12, a strap supply or dispenser (not shown) and a control system 22. It is to be noted that the strapping heads 12 are independent of one another, such that either or both of the strapping head 12 subsystems can be operated at any given time. To this end, the chute 20 systems and control systems 22 are independent of one another as well.

The feed head 14 is that assembly within the strapping machine 10 that conveys the strap material S (see, e.g., FIG. 6) through the sealing head 16 and into the chute 20. The strap material traverses through the chute 20 back around to the sealing head 16. In the illustrated machine 10, the strap is conveyed downward from the feed head 14, through the sealing head 16, toward the bottom portion 24 of the chute 20. The strap continues upwardly around the far side 26 of the chute 20, across the top 28 of the chute 20 and back to the sealing head 16.

Upon return to the sealing head 16, the strap is gripped by a gripper (not shown) in the sealing head 16. The feed mechanism 14 then reverses to tension the strap. The head 16 floats downward in response to strap tensioning. When a desired tension is achieved, the tensioned end of the strap is gripped and the strap is cut to separate the strap from the source. The strap is welded or otherwise sealed onto itself by methods known in the art. The load is then removed from inside the chute 20 region or strap path and a new load is positioned therein for strapping.

As set forth above, the present strapper 10 is unique in that it uses a side seal arrangement for strapping incompressible, debris laden material. It is further unique in that the strapper 10 carries out these functions in a unit that includes a modular component arrangement (i.e., a modular feed head 14 and a modular sealing head 16). The machine 10 is further unique in that the side seal arrangement provides for tensioning the strap from the bottom of the load up. This results in a tighter bottom strap which enhances package integrity. This arrangement also enables enhanced visual inspection by the operator, during operation, and further provides an ergonomic lifting position for manual removal and replacement of the heads 14, 16.

The modular components are as described in the above-noted patent to Flaum et al. In this arrangement, separate feed heads 14 and sealing heads 16 are independently positioned and mounted to a carriage 30 that is mounted to the strapping machine frame 18. Referring to FIGS. 6–11, the carriage 30 includes a receiver region 32 having a feed head receiver 34 and a sealing head receiver 36. The receivers 34, 36 are positioned with the feed head receiver 34 above the sealing head receiver 36. In this manner, the strap is fed into the top of the feed head 14, and is directed or fed downwardly through the sealing head 16, into the strap chute 20.

The feed head receiver 34 includes a support plate 38 on which the head 14 rests. A lip 40 is positioned about the periphery of the plate 38 to prevent the head 14 from inadvertently falling from the plate 38 when the head 14 is removed from the receiver 34. The head 14 has rollers 42 mounted to the base thereof for ease of moving the head 14 into and out of the receiver 34 (for rolling the head 14 along the plate 38). A latch 44 is position at the top of the receiver 34 that cooperates with a latching portion, e.g., a latch bar 46 on the feed head 14. In this manner, the head 14 locks or latches into place in the receiver 34.

The sealing head 16 is mounted to the carriage 30 at the sealing head receiver 36. Like the feed head 14, the sealing head 16 includes rollers 48 to facilitate readily installing and removing the head 16 from the receiver 16. However, the sealing head rollers 48 are positioned at about an upper region of the head 16 so that the head 16 "hangs" as it is supported by the rollers 48.

The sealing head receiver 36 includes an upper plate 50 (from which the head 16 hangs) that includes a notch 52 formed therein. The head 16 includes a clamp 54 that locks the head 16 to the plate 50. In a present arrangement, as disclosed in the above-noted patent to Flaum et al., the clamp 54 is a hand-tightened element, such as a threaded stud 56 (having a handle 58) that threadedly engages or tightens onto the plate 50 when the stud 56 is positioned in the notch 52.

Figure 6:
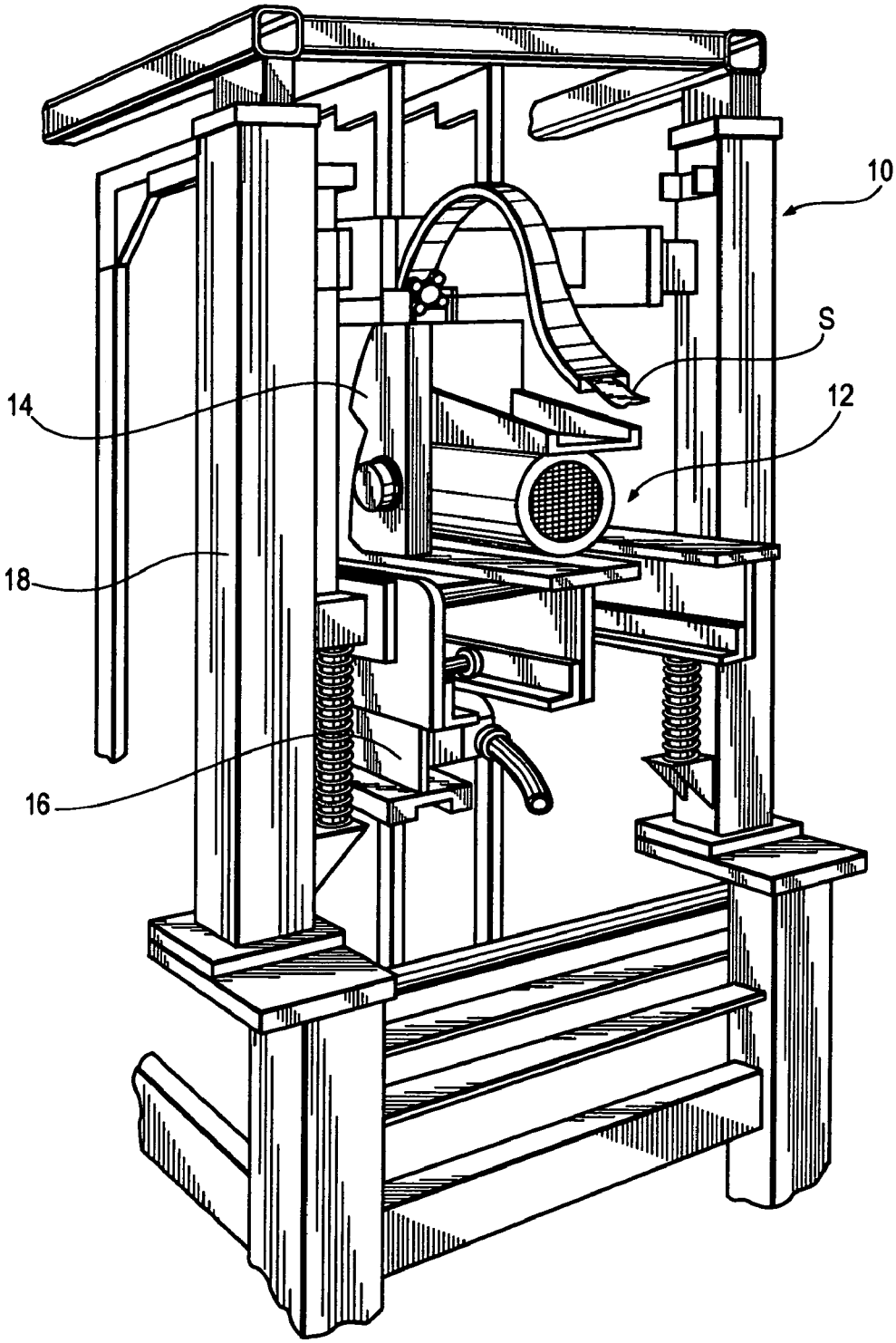
FIG. 6 is a view of the front of the strapper (e.g., an operator's view) showing the feed and sealing head modules of one of the (two) tandem, side-by-side strapping heads.
Figure 7:
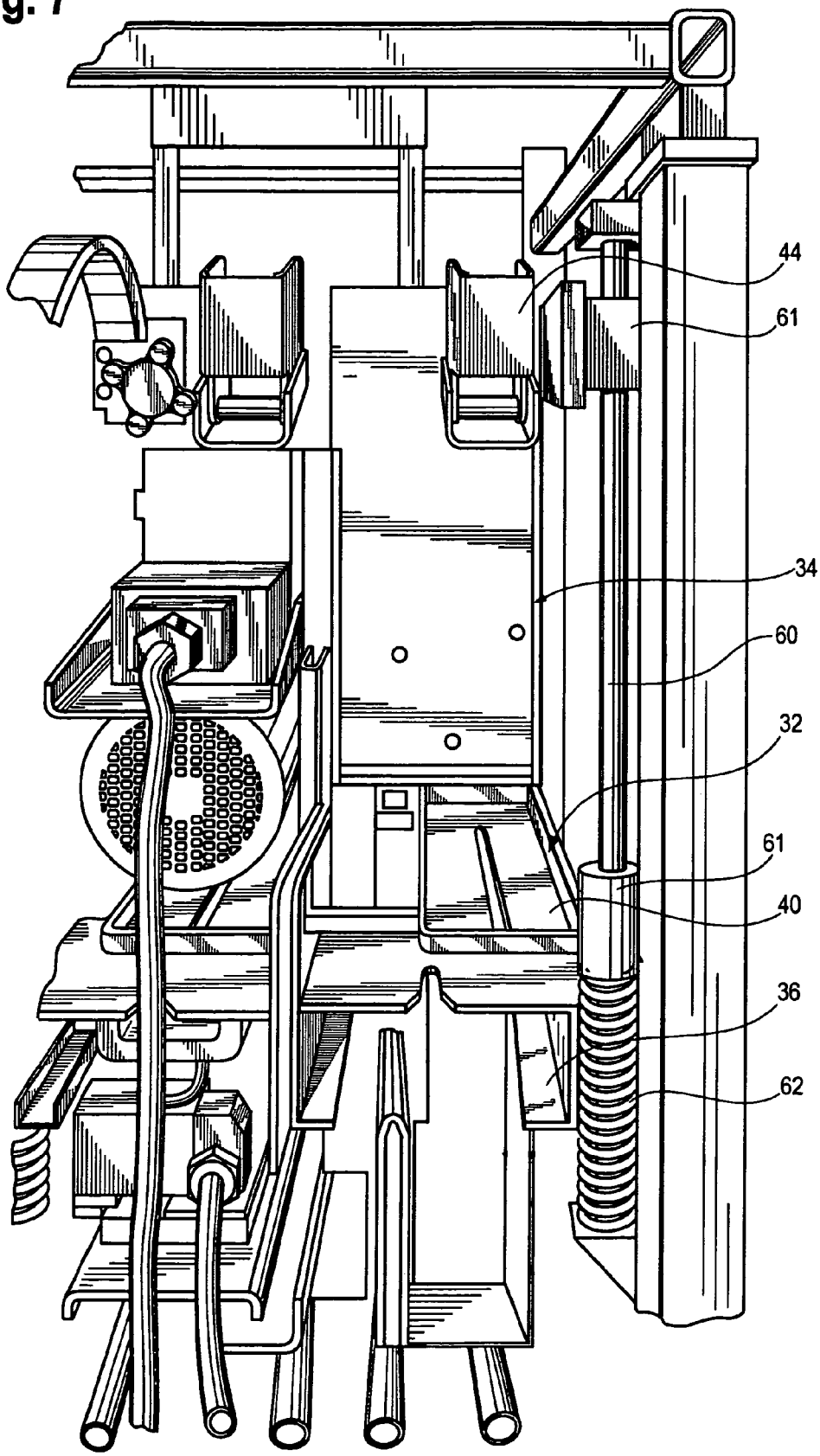
FIG. 7 is a view of the front of the strapper illustrating one set of open receiving areas for the feed and sealing head modules in the side-by-side strapping head arrangement and showing the floating head mount.
Figure 8:
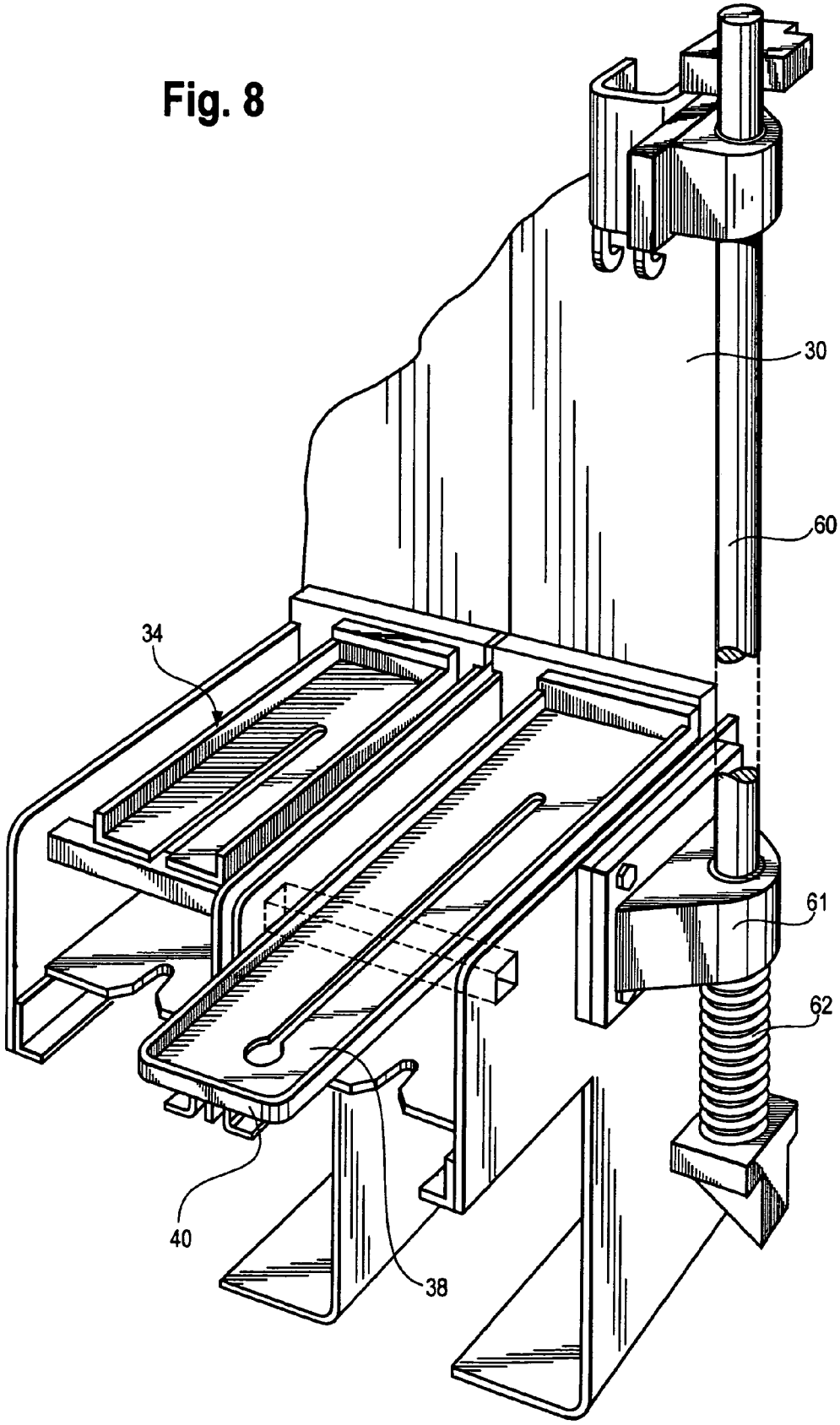
FIG. 8 is a view of the module receiving areas, showing the floating head mount.
Figure 9:
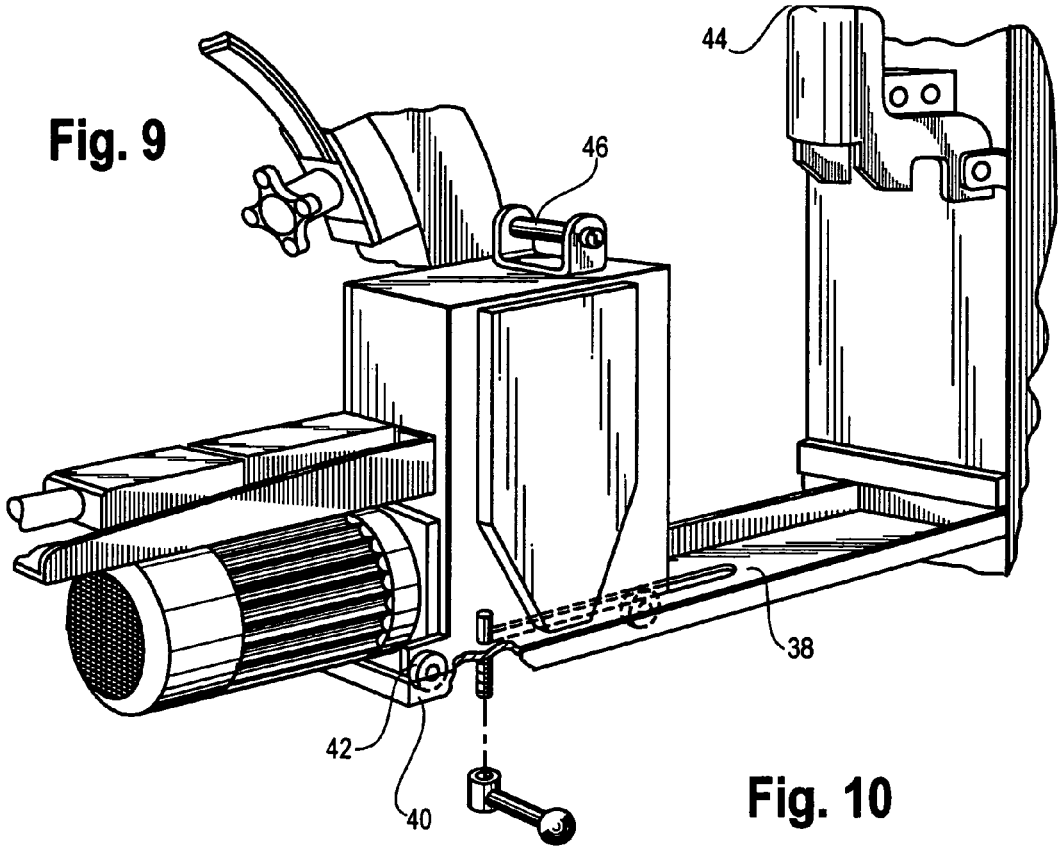
FIG. 9 is a view of the feed head and receiving area, showing the feed head partially within (installed or removed from) the receiver.
Figure 10:
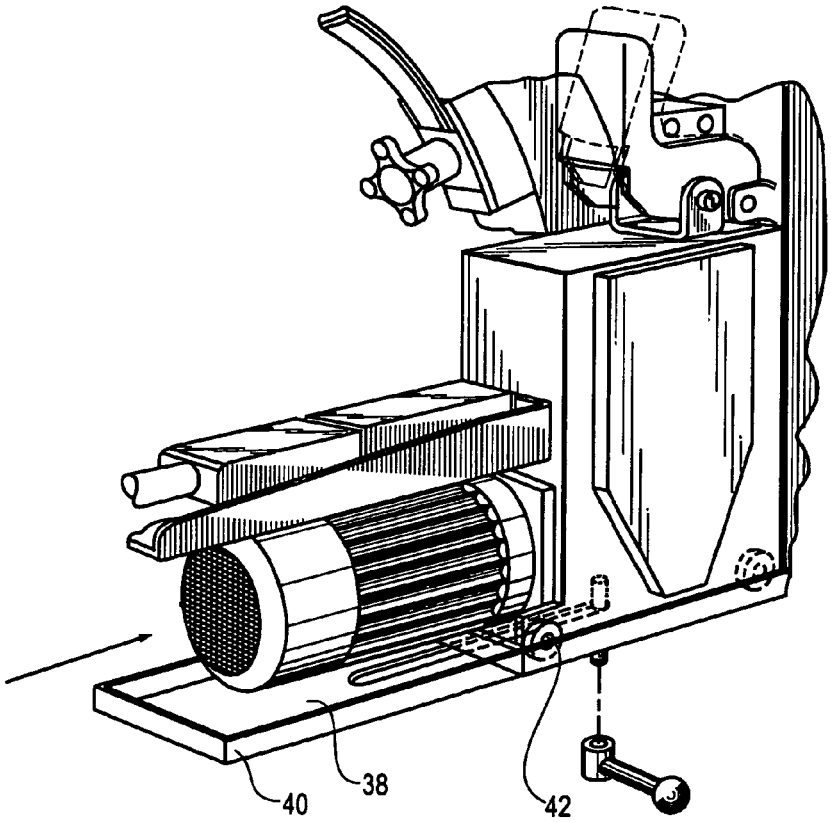
FIG. 10 is view of the installed feed head showing the head locked into position in the receiver.
Figure 11:
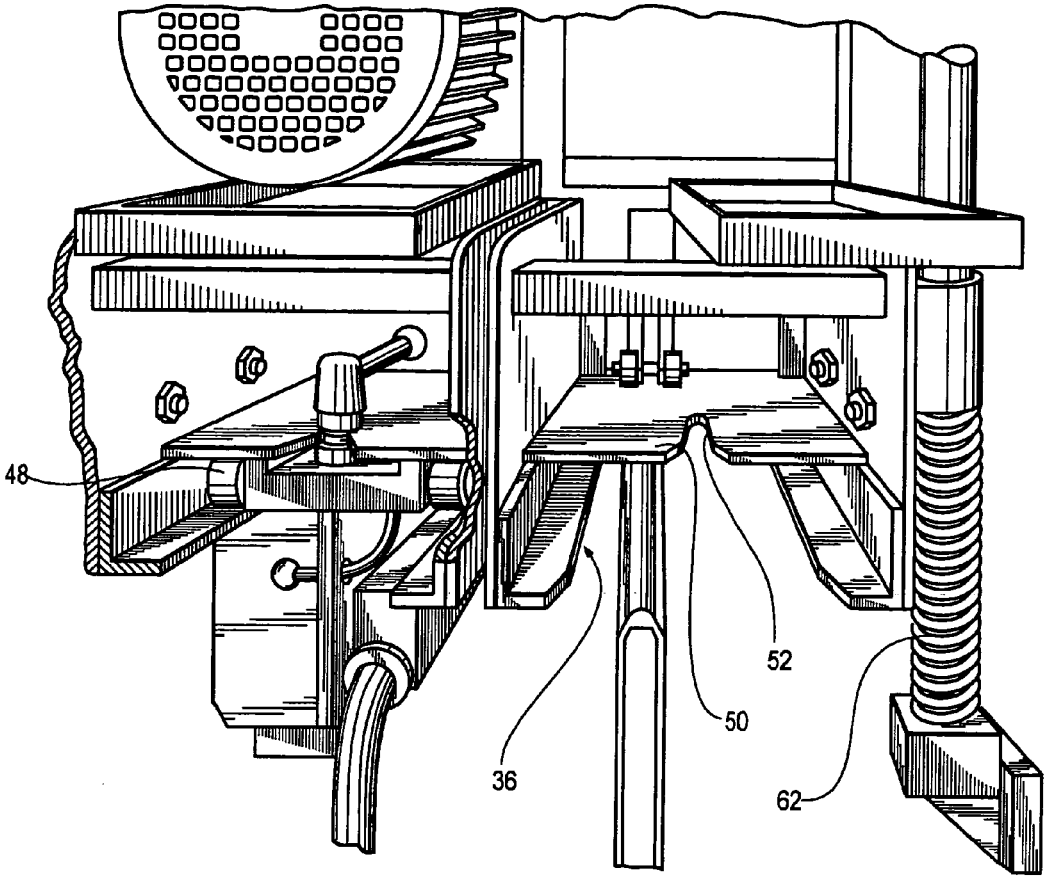
FIG. 11 is an enlarged view of looking into the receiving areas and showing one of the sealing heads and one of the feed heads in place.
Figure 12:
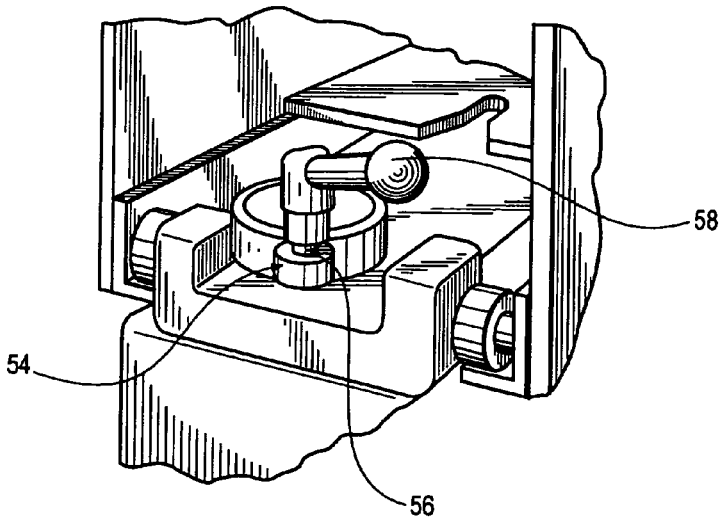
FIG. 12 illustrates a clamping arrangement for maintaining the sealing head in place in the receiver.
Figure 13:
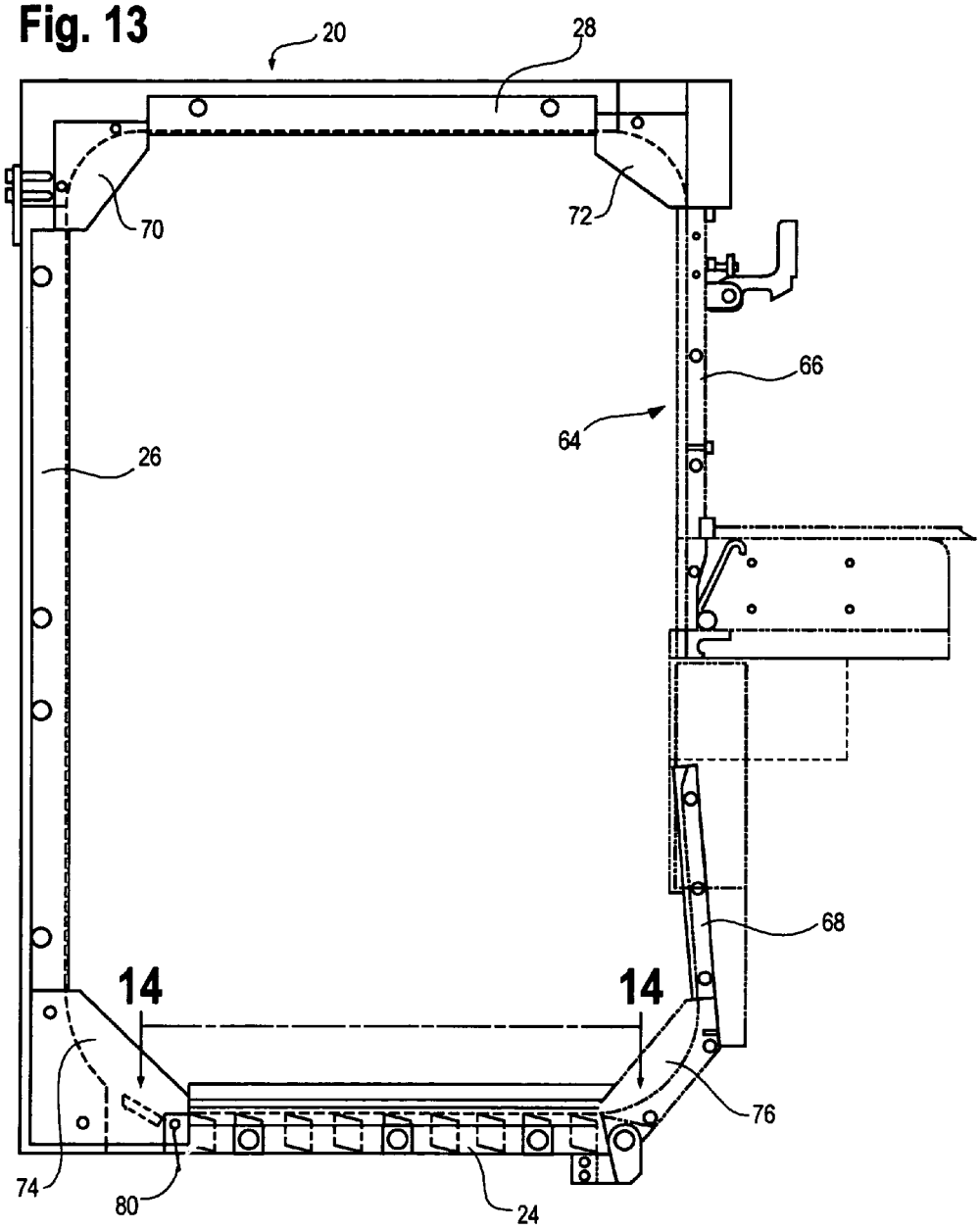
FIG. 13 is side view chute system showing the sealing and feed head carriage, and further illustrating the "floating" connection between the lower head-side chute section and the bottom chute section, and further illustrating a portion of the passive debris ejection system, and an internal chute guide for directing the strap over the debris ejection opening.
Figure 14:
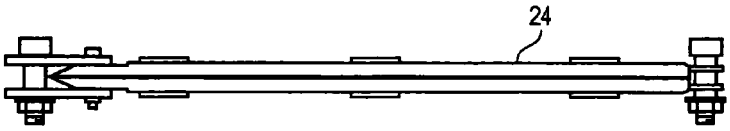
FIG. 14 is a view taken along line 14—14 of FIG. 13.
Figure 17:
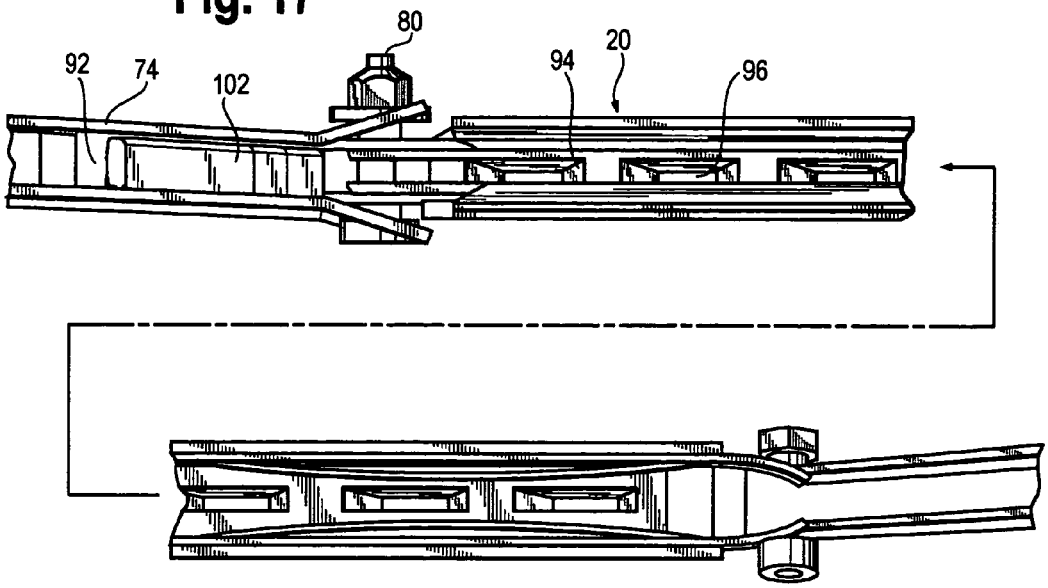
FIG. 17 is a top view of the bottom chute portion illustrating portions of the passive debris ejection system and the chute portion showing the slotted pivot.
Figure 18:
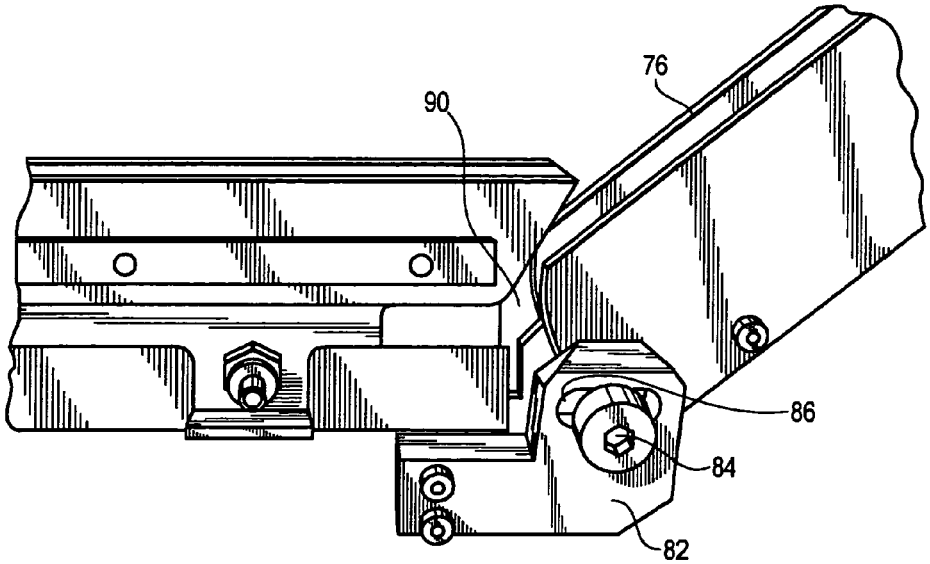
FIG. 18 is a side view of the chute alignment system showing the "floating" connection between the lower head-side chute section and the bottom chute section.

Referring to FIGS. 6–8, the carriage 30 is mounted to the frame 18 by linear bearings 61 riding along a shaft 60. A biasing element 62, such as the illustrated coil spring, is disposed about the shaft 60, below the bearings 61 to provide a counterbalance arrangement for the heads 12 and carriage 30. It will be appreciated that during the strapping cycle, as the strap is tensioned about the load (bundle of bricks), the act of tensioning the strap tends to compress the load and to drive the tensioning element in the direction of the tensioning force. In this case, the tensioning element is, collectively, the strapping head 12 which includes the feed head 14. In that the load is substantially incompressible, the tendency is to create a greater driving force to drive the tensioning element (or head 12) downward.

The floating mount permits movement of the head 12 (by movement of the carriage 30) downward. In this manner, as the strap is tensioned, rather than over-tensioning the strap, the head 12 "floats" downward (along the shaft 60) toward the floor. After sealing of the strap and releasing of the grippers (not shown, but within the heads 12), the head 12 (carriage 30) is returned to its normal operating position by the spring 62 force. Those skilled in the art will appreciate that cylinders or other devices/assemblies can be used to return the carriage 30 to its operating position.

Referring to FIGS. 2–5 and 13–22, the strap chute 20 surrounds the load as the load is positioned in the machine 10. As illustrated, the strap chute 20 is formed as a generally rectangular channel through which the strap traverses. For purposes of the present description, the chute will be viewed as having four separate sections, namely, the bottom portion or section 24, the far side section 26, the top section 28 and a near side or head-side section 64. The head-side section 64 is further divided into an upper head-side section 66 and a lower head-side section 68 with the sealing head 16 disposed between the upper and lower head-side sections 66, 68. Transition sections 70, 72 are disposed between the top section 28 and the far side section 26 and between the top section 28 and the upper head-side section 66. Likewise, transition sections 74, 76 are disposed between the bottom 24 and far side section 26 and the bottom 24 and lower head-side section 68.

The strap chute sections are either fixed (far side section 26, top section 28 and upper head-side section 66) relative to the strapping heads 12 or float (lower head-side section 68 and bottom section 24) along with the strapping heads 12. The fixed sections are fixedly mounted to the frame 18. The floating sections float by virtue of attachment to the carriage 30 or to one another. In this manner, floating of the heads 12 is accommodated by or accounted for by movement of the strap chute sections 24 and 68 with the heads 12, while at the same time, taking into account the necessity of maintaining gaps (as indicated at 78) between the strap carrying components (e.g., between the head 16 and the lower head-side section 68) as small as possible to maintain control and direction of strap conveyance though the chute 20. That is, if the lower head-side section 68 was not designed to float along with the strapping head 12, the gap between the strapping head 12 and the lower head-side section 68 would have to be large enough to accommodate movement of the head 12 as it floats. This, however, would result in a gap that is so large (during strap feed) that the opportunity to misfeed strap would be greatly increased.

The lower head-side section 68 is fixedly mounted to the carriage 30. In this manner, as the carriage 30 moves up and down, the lower head-side section 68 likewise moves up and down. This permits the lower head-side section 68 to be mounted sufficiently close to the head 16 (i.e., with minimal gap) to reduce the opportunity for strap misfeed, yet contain adequate size debris openings.

The bottom section 24 is pivotally mounted to the lower head-side section 68 and the far side section 26. More specifically, the bottom to far side transition 74 is fixedly mounted to the far side section 26, and as such the bottom section 24 is movably mounted to that transition section 74. Likewise, the transition 76 between the lower head-side section 68 and the bottom section 24 is fixedly mounted to the lower head-side section 68 and as such, the bottom section 24 is movably mounted to that transition 76 section, as well.

To accommodate the movement of the bottom section 24, pivot mounts 80, 82 are positioned at each of the bottom section 24 to transition 74, 76 junctures. The pivot mount 80 at the bottom section 24 to far side transition 74 is a fixed pivot. That is, it is a conventional rotating pivot. The pivot 82 at the bottom section 24 to lower head-side section transition 76, on the other hand, is a floating pivot. As seen in FIGS. 16 and 18–22, a pivot pin 84 floats in an elongated slot 86. This configuration permits an additional degree of freedom of movement (e.g., linear as well as rotational) to accommodate movement of the lower head-side section 68 due to strapping head 12 float. The pivoting connections of the bottom chute section 24 to the far side 26 and lower head-side 68 chute sections provide for self alignment of the chute sections 24, 26, 68 upon return of the carriage 30 (heads 12) to the operating position after downward float and upward return. It will be appreciated by those skilled in the art that the locations of the fixed and floating pivots can be reversed (that is locating the fixed pivot at the lower head-side section transition and locating the floating pivot at the far side transition), and that such an alternate arrangement is within the scope and spirit of the present invention.

Another important advantage of the present chute 20 system is the passive debris ejection feature. Referring to FIGS. 13 and 17–22, debris ejection is provided by an open slotted bottom chute section 88 and partially open bottom transition sections 90, 92. The open slotted bottom section 88 is formed as a plurality of spaced guide elements 94 with openings 96 between the elements 94 to permit debris to "fall" from the chute 20 through the openings 96. The elements 94 have upwardly inclined guide surfaces 98 that maintain the strap within the chute 20 as the strap is conveyed along the chute 20. The inclined surfaces prevent the strap from inadvertently or improperly exiting the chute 20 between the guide elements 94.

The open bottom transition sections 90, 92 likewise provide an egress for debris that might otherwise become lodged in and clog the chute 20. The open bottom areas 90, 92 are large and are configured to permit the free flow of debris from the chute 20.

Figure 19:
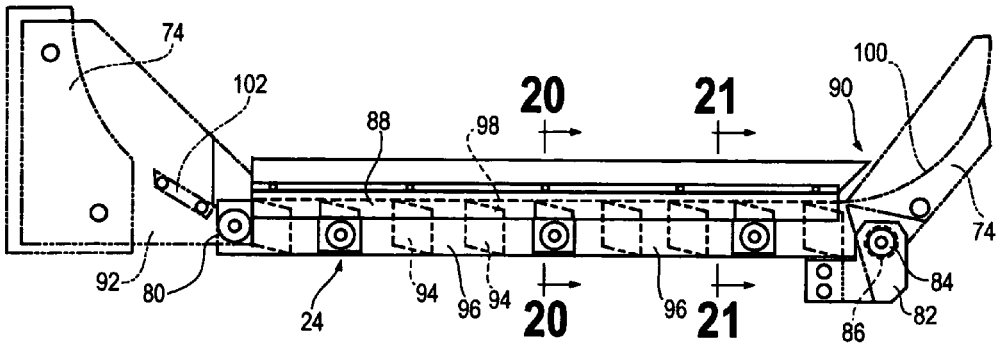
FIG. 19 is a side view of the bottom chute section showing the passive debris ejection system, in part, in phantom lines.
Figure 20:
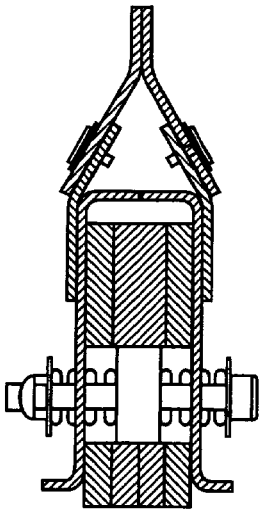
FIGS. 20 and 21 are cross-sections taken along lines 20 and 21, respectively, in FIG. 19.
Figure 21:
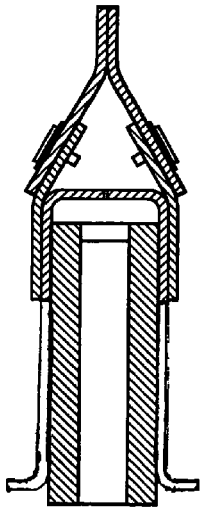
Figure 22:
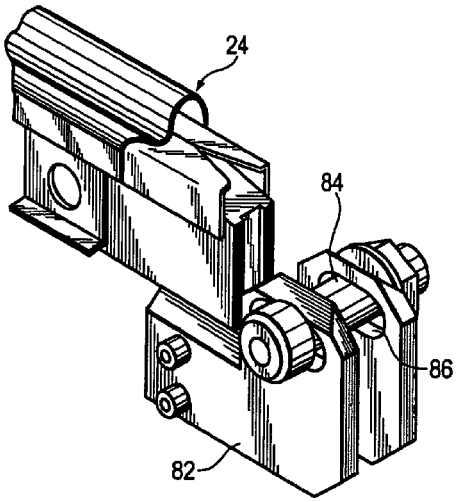
FIG. 22 is a perspective view of the floating connection between the lower head-side chute section and the bottom chute section.

Turning guides 100, 102 are positioned to assure that the strap is properly directed or conveyed around the "corners" where the bottom section 24 to side sections 26, 68 are open. The turning guides 100, 102 provide a surface from which the strap can "jump" from one section to the next. As can be seen in FIG. 19, the turning guides 100, 102 are configured with sufficient inclination so as to direct the strap along the "landing site" (of the bottom section 24 or the bottom to far side transition 74) downstream of the leading edge of the landing site. Advantageously, this arrangement maintains the strap within the chute 20, again preventing the strap from inadvertently or improperly falling through the open corners 90, 92.

Other features of the machine 10 include a pair of strapping head guards 104 (FIGS. 4 and 5), one each associated with a respective strapping head 12. The guards 104 are positioned about the heads 12 and the upper and lower head-side chute sections 66, 68. The guards 104 are replaceable to provide a replaceable wear surface and to protect the heads 12 from damage by a load as the load is moved into or out of the chute 20.

In operation, strap is fed into the strapping machine 10 and enters at about the top of the feed head 14. The strap is directed downward, through the feed head 14, into the sealing head 16 and the lower head-side chute section 68. The strap is directed by the turning guide 100 into the bottom chute section 24 and continues across the bottom section 24 to the turning guide 102 to transition into the far side section 26. The strap continues up the far side 26, across the top section 28 and down the upper head-side section 66, traversing back in to the sealing head 16. Upon return to the sealing head 16, the free end of the strap is gripped and strap feed stops. When the load is ready, the feed head 14 then reverses to tension the strap.

In that the load is essentially incompressible, as slack is drawn from the strap and as the strap tension increases, the strapping head 12, as carried by the carriage 30, and which floats, is "pulled" downward, while at the same time the strap is pulled from the chute 20 onto the load. As this occurs, the lower head-side chute section 68 likewise floats down and the bottom chute section 24 pivots downwardly, to accommodate the float. Once the strap is tensioned around the load, the strap is sealed to itself and severed from the supply. The load can then be removed from the chute 20 area and a subsequent load positioned for strapping.

As the strap is tensioned around the load (and generally, as the load is manipulated in the strapping machine 10, particularly when the load is a brick bundle), debris is typically generated. As the debris falls from the bricks it has been observed that in prior, known strapping machine, a significant amount of the debris can fall in to the chute. This can adversely effect the operation of the strapper (clogging the chute and causing strap misfeed), and greatly increases the maintenance required. The present strapping machine 10, with the passive debris ejection system provides for the ejection of the debris from the machine 10, without additional moving or driven parts, and more significantly, without added machine down time.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A side seal strapping machine configured to feed a strapping material around a load, position, tension and seal the strapping material around the load, the strapping machine comprising:

a frame having a biased, movable carriage mounted thereto;

a modular sealing head mounted to the carriage;

a modular feed head mounted to the carriage; and a strap chute mounted to the frame, wherein the carriage is mounted to the frame by a linear bearing mounted to a shaft, the carriage being biasedly mounted to the frame by a spring disposed about the shaft, and wherein when strap material is fed into the strapping machine through the feed head and the sealing head into the strap chute, the strap traverses through the chute and is tensioned around the load, and wherein during tensioning, the carriage, carrying the sealing head and the feed head, floats and is moved downward in the direction of tensioning.

2. The side seal strapping machine in accordance with claim 1 wherein the carriage includes a feed head receiver region to carry the feed head and a sealing head receiver region to carry the sealing head.

3. The side seal strapping machine in accordance with claim 1 including two movable carriages mounted to the frame in side-by-side relation to one another, each carriage including a modular sealing head and a modular feed head mounted thereto, each carriage having a strap chute associated therewith mounted to the frame, the modular sealing heads and the modular feed heads being operable independently of one another.

4. A side seal strapping machine configured to feed a strapping material around a load, position, tension and seal the strapping material around the load, the strapping machine comprising:

a frame having a biased, movable carriage mounted thereto;

a modular sealing head mounted to the carriage;

a modular feed head mounted to the carriage; and a strap chute mounted to the frame, the strap chute having a movable bottom chute section and a movable lower head-side chute section adjacent the sealing head, the movable lower head-side chute section being movable with the carriage, the movable lower head-side chute section and the movable bottom chute section being hingedly connected to one another for cooperative movement, wherein the movable strap chute sections provide a self aligning strap path, wherein when strap material is fed into the strapping machine through the feed head and the sealing head into the strap chute, the strap traverses through the chute and is tensioned around the load, and wherein during tensioning, the carriage, carrying the sealing head and the feed head, floats and is moved downward in the direction of tensioning.

5. The side seal strapping machine in accordance with claim 4 wherein the strap chute includes a bottom chute section, and wherein the strap chute includes a passive debris ejection system including openings formed in the bottom chute section and openings formed at junctures of the bottom chute section and sections adjacent thereto, wherein debris that is generated during handling of the load is ejected from the strap chute through the openings formed in the bottom chute section and the openings formed at the junctures of the bottom chute section and sections adjacent thereto.

6. A strapping machine configured to feed a strapping material around a load, position, tension and seal the strapping material around the load, the strapping machine comprising:

a frame;

a sealing head;

a feed head, the sealing head and the feed head being slidingly mounted to the frame by a bearing mounted to a shaft, the sealing head and the feed head being biasedly mounted to the frame by a spring; and a strap chute, the sealing head and the feed head operably mounted to one another and operably mounted to the frame along a side of the frame for vertical movement thereon, wherein when strap material is fed into the strapping machine through the feed head and the sealing head into the strap chute, the strap traverses through the chute and is tensioned around the load, and wherein during tensioning, a carriage, carrying the sealing head and the feed head, floats and is moved downward in the direction of tensioning.

7. The strapping machine in accordance with claim 6 wherein the spring is disposed about the shaft.

8. The strapping machine in accordance with claim 6, the strap chute having a movable bottom chute section and a movable lower head-side chute section adjacent the sealing head, the movable lower head-side chute section being movable with the carriage, the movable lower head-side chute section and the movable bottom chute section being hingedly connected to one another for cooperative movement, wherein the movable strap chute sections provide a self aligning strap path.

9. A strapping machine configured to feed a strapping material around a load, position, tension and seal the strapping material around the load, the strapping machine comprising:

a frame;

a sealing head operably mounted to the frame;

a feed head operably mounted to the frame; and a strap chute operably mounted to the frame the strap chute including a bottom chute section, and wherein the strap chute includes a passive debris ejection system including generally downwardly oriented openings formed in the bottom chute section, wherein debris that is generated during handling of the load is ejected from the strap chute through the openings formed in the bottom chute section.

10. The strapping machine in accordance with claim 9 including openings formed in the strap chute at junctures of the bottom chute section and sections adjacent thereto, wherein debris that is generated during handling of the load is ejected from the strap chute through the openings formed in the bottom chute section and the openings formed at the junctures of the bottom chute section and sections adjacent thereto.

11. The strapping machine in accordance with claim 10 wherein the bottom chute section and the sections adjacent thereto are hingedly mounted to one another.

12. The strapping machine in accordance with claim 9 wherein the feed head and the sealing head are mounted to the frame to allow for vertical movement to accommodate strap tensioning about the load and wherein the strap chute is operably mounted to the feed head and the sealing head for movement in response to and to accommodate the vertical movement of the feed head and the sealing head.

13. The strapping machine in accordance with claim 12 wherein the bottom chute section and strap chute sections adjacent thereto are hingedly mounted to one another.

14. The strapping machine in accordance with claim 13 including openings formed in the strap chute at junctures of the bottom chute section and the sections adjacent thereto, and wherein debris that is generated during handling of the load is ejected from the strap chute through the openings formed in the bottom chute section and the openings formed at the junctures of the bottom chute section and sections adjacent thereto.

* * * * *